US009170011B2

(12) United States Patent
Lo et al.

(10) Patent No.: US 9,170,011 B2
(45) **Date of Patent: *Oct. 27, 2015**

(54) HIGH-POWER LED LAMP

(71) Applicants: Honhung Lo, Hong Kong (CN); Kuan Ding, Jiangsu (CN)

(72) Inventors: Honhung Lo, Hong Kong (CN); Kuan Ding, Jiangsu (CN)

(73) Assignees: Honhung Lo, Hong Kong (CN); Kuan Ding, Jiangsu (CN)

( * ) Notice: Subject to any disclaimer, the term of this patent is extended or adjusted under 35 U.S.C. 154(b) by 0 days.

This patent is subject to a terminal disclaimer.

(21) Appl. No.: 14/188,254

(22) Filed: Feb. 24, 2014

(65) Prior Publication Data

US 2014/0198502 A1 Jul. 17, 2014

Related U.S. Application Data

(63) Continuation-in-part of application No. 13/768,852, filed on Feb. 15, 2013, now abandoned, which is a continuation of application No. 12/742,994, filed as application No. PCT/CN2008/073020 on Nov. 12, 2008, now Pat. No. 8,398,265.

(30) Foreign Application Priority Data

Nov. 14, 2007 (CN) ..... 2007 2 0191684 U

(51) Int. Cl.

| | |
|---|---|
| ***F21V 29/00*** | (2015.01) |
| ***F21K 99/00*** | (2010.01) |
| ***F21V 5/00*** | (2015.01) |
| ***F21V 5/04*** | (2006.01) |
| ***F21V 23/02*** | (2006.01) |
| ***F21V 29/89*** | (2015.01) |
| *F21Y 101/02* | (2006.01) |
| *F21Y 105/00* | (2006.01) |
| *F21V 29/83* | (2015.01) |

(52) U.S. Cl.

CPC ..... *F21V 29/004* (2013.01); *F21K 9/137* (2013.01); *F21V 5/007* (2013.01); *F21V 5/04* (2013.01); *F21V 23/026* (2013.01); *F21V 29/89* (2015.01); *F21V 29/83* (2015.01); *F21Y 2101/02* (2013.01); *F21Y 2105/001* (2013.01)

(58) Field of Classification Search

CPC ..... F21V 23/026

See application file for complete search history.

(56) References Cited

U.S. PATENT DOCUMENTS

| | | | |
|---|---|---|---|
| 2005/0174780 | A1 | 8/2005 | Park |
| 2007/0025109 | A1 | 2/2007 | Yu |
| 2010/0254127 | A1 | 10/2010 | Yang |

FOREIGN PATENT DOCUMENTS

| | | | |
|---|---|---|---|
| CN | 2747464 | Y | 12/2005 |
| CN | 2755413 | Y | 2/2006 |
| CN | 2766144 | Y | 3/2006 |

*Primary Examiner* — Mary Ellen Bowman

(74) *Attorney, Agent, or Firm* — Drinker Biddle & Reath LLP

(57) ABSTRACT

A high-power LED lamp set is provided in the present invention. The high-power LED lamp set comprises: a power converting module; a power supply casing (2) for housing the power converting module; a light source casing (4), connected with the power supply casing; electrode rods (1), arranged at a rear end of the power supply casing (2) and connected with the power converting module; and LED lamps (7), mounted on a bottom surface of the light source casing (4); said light source casing (4) is provided with a lens board (5) at its opening end, wherein the lens board (5) is perforated with through holes at the positions corresponding to the LED lamps, and a high transmittance lens (8) is embedded in each of the through holes.

7 Claims, 1 Drawing Sheet

HIGH-POWER LED LAMP

RELATED APPLICATIONS

This application is a continuation-in-part of U.S. application Ser. No. 13/768,852, filed Feb. 15, 2013, which claims priority to U.S. application Ser. No. 12/742,994, filed Jul. 26, 2010 (now U.S. Pat. No. 8,398,265, issued Mar. 19, 2013), which is a national stage application (under 35 U.S.C. §371) of PCT/CN2008/073020, filed Nov. 12, 2008, which claims priority to Chinese Application No. CN2008/073020, filed on Nov. 14, 2007, all of which are incorporated herein by reference.

TECHNICAL FIELD

The present invention relates to semiconductor lighting technology, and particularly to an integrated high-power LED lamp set.

BACKGROUND

LED is a kind of green and environment-friendly light source with the advantages of high luminous efficiency, less power consumption, long life, high reliability, easy to control, etc. LED is commonly used as a backlight source in mobile phones or as an indicator light in other devices, but its applications are not limited to this. LED also has promising prospect for its development and presents big market potential in the aspect of lighting application. Recently, LED has obtained so great development as to start its commercial application in lighting field and will gradually replace the existing fluorescent lamps. That is, the high-power LED lamp will become a practical lighting equipment for a variety of applications as it is economical and stable.

However, most of the existing high-power LED lamps must be provided with an external or separate power and/or control device to protect the LED lamps from burning up due to insufficient heat dissipation or unstable driving voltage and inconstant current.

SUMMARY OF THE INVENTION

An object of the invention is to solve the problems in the prior art by providing a high-power LED lamp set, in which both a power converter and a light driver are integrated into and embedded within the lamp per se. The LED lamp set according to the present invention may be used directly at various lobbies and indoor areas where there is a need for lighting.

In an aspect of the present invention, the high-power LED lamp set comprises:

to a power converting module;

a power supply casing, for housing the power converting module;

a light source casing, connected with the power supply casing;

electrode rods, arranged at a rear end of the power supply casing and connected with the power converting module; and LED lamps, mounted at the bottom surface of the light source casing;

wherein the light source casing is provided with a lens board at its opening end, and the lens board is perforated with through holes at positions corresponding to the LED lamps, and a high transmittance lens is embedded in each of the through holes.

In the high-power LED lamp set, the light source casing is provided with blind-holes at its bottom, each blind-hole having a small through hole at its center, and the LED lamps are mounted within the light source casing at the bottom surface of the light source casing through the blind-holes and the small through-holes.

In the high-power LED lamp set, the power supply casing has a rectangle part and a spherical part that are integrally formed as one-piece.

In the high-power LED lamp set, the light source casing has a bowl-like shape with a flat bottom.

In the high-power LED lamp set, the power converting module, which is located within the power supply casing, comprises circuits with voltage converting, current rectifying and LED driving functions. With these circuits, the converted low-voltage output may be further rectified and regulated to produce a constant driving current. This may solve the problems caused by the sharp voltage-current characteristic of LED, avoiding a fluctuation in the LED driving current which may cause the voltage increasing sharply to burn the LED down. In this way, the proper operation of the LED can be ensured. Meanwhile, the electro-optic conversion efficiency of the LED lamp set is up to 70-120 lm/W, which is greater than that of the existing fluorescent lamp.

In the high-power LED lamp set, the power supply casing and the light source casing are connected and fixed together via bolts.

In the high-power LED lamp set, there are grooves for heat dissipation arranged on an external surface of the curving wall of the light source casing.

In the high-power LED lamp set, there is a ring groove arranged along the inner circumference of each of the through holes on the lens board and a high transmittance lens is fitted within the ring groove.

In another aspect of the present invention, the high-power LED lamp set comprises:

a power supply casing;

electrode rods, arranged at a rear end of the power supply casing, for connecting to an external high-voltage AC power source;

a power converting module, located within the power supply casing and connected with the electrode rods, for converting the high-voltage AC from the electrode rods into a constant low-voltage DC driving current;

a light source casing, connected with the power supply casing; and a plurality of LED lamps, mounted on a bottom surface of the light source casing and driven by the driving current provided by the power converting module, and wherein said light source casing is provided with a lens board at its opening end, wherein the lens board is perforated with through holes at positions corresponding to the LED lamps, and a high transmittance lens is fitted in each of the through holes.

In the high-power LED lamp set, the light source casing is provided with blind-holes at its bottom, each blind-hole having a small through holes at its center; LED lamps are mounted on the bottom surface of the light source casing through the blind-holes and the small through-holes.

In the high-power LED lamp set, the power supply casing has a rectangle part and a spherical part that are integrally formed as one-piece.

In the high-power LED lamp set, the light source casing has a bowl-like shape with a flat bottom.

In the high-power LED lamp set, the power converting module, which is located within the power supply casing, comprises circuits with voltage converting, current rectifying and LED driving functions. With these circuits, the converted low-voltage output may be further rectified and regulated to produce a constant driving current. This may solve the problems caused by the sharp voltage-current characteristic of LED, wherein a fluctuation in the LED driving current may cause the voltage increasing sharply to bum the LED die. In this way, the proper operation of the LED can be ensured by the produced constant current. Meanwhile, the electro-optic conversion efficiency of the LED lamp set is up to 70-120 lm/W, which is greater than that of the existing fluorescent lamp.

In the high-power LED lamp set, the power supply casing and the light source casing are connected and fixed together via bolts.

In the high-power LED lamp set, grooves for heat dissipation are arranged on an external surface of a curving wall of the light source casing.

In the high-power LED lamp set, a ring groove is arranged along the inner circumference of each of said through holes on the lens board and the high transmittance lens is fitted within the ring groove.

In the present invention, either the alternate current with power line frequency or the direct current may be directly fed to the LED lamp set through the electrode rods as the input. The current from the electrode rods is converted, rectified and regulated by the power converting module in the power supply casing so as to provide a constant driving current to the LED lamp set. The light source casing is made of aluminum alloy that has good capability in heat dissipation, and the grooves arranged on the external surface thereof further enhances its capability in heat dissipation. Furthermore, in the present invention, the power converting module is integrated with the light source driving function, and the power supply casing is connected with the light source casing. This allows the LED lamp set to be an economical and practicable lighting equipment with small size.

1—electrode rods;
2—a power supply casing;
3—bolts;
4—a light source casing;
5—a lens board;
6—grooves for heat dissipation;
7—LED lamps;
8—high transmittance lens

DETAILED DESCRIPTION OF THE INVENTION

Figure 1:
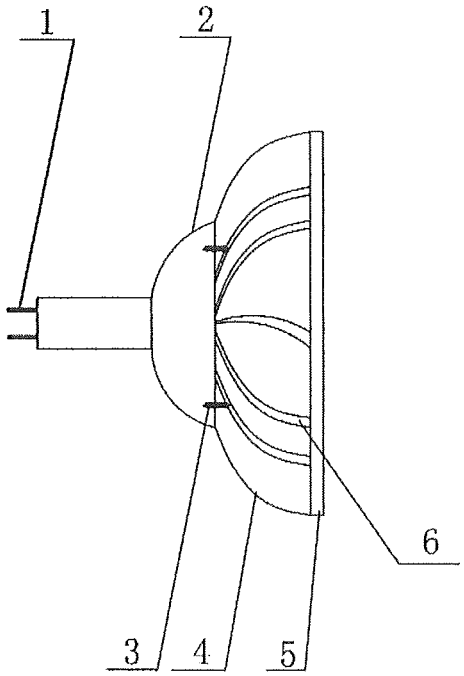
FIG. 1 is a schematic diagram showing the structure of the high-power LED lamp set according to an embodiment of the present invention.
Figure 2:
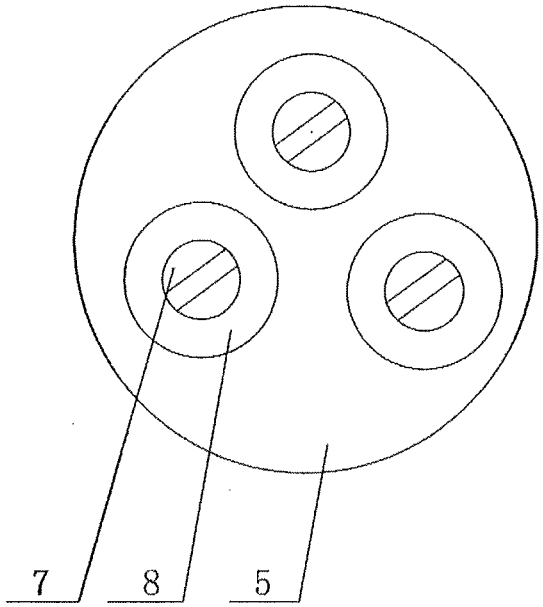
FIG. 2 is a right side view of the high-power LED lamp shown in FIG. 1, wherein the reference numbers in the drawings refer to the following elements respectively.

As shown in FIGS. 1 and 2, according to the present invention, the high-power LED lamp set includes: a power supply casing 2 and a light source casing 4 that are connected and fixed together via bolts 3, wherein the power supply casing 2 is used for housing a power converting module. The power supply casing 2 is made of plastic material and consisted of a rectangle part and a spherical part that are integrally formed as one-piece.

The light source casing 4 is made of aluminum alloy and has a bowl shape with a flat bottom. Grooves 6 for heat dissipation are arranged on the external surface of the curving wall of the light source casing 4. Arranged on the bottom of the light source casing are 3-6 blind-holes, each having a small through-hole located at its center. Through each blind-hole and the respective small through-hole, one LED lamp 7 is mounted on the bottom surface of light source casing 4, and connected to the power converting module via a wire conductor passing through the small through-hole. The color and the power of LED lamps 7 may be selected based on users' preferences and the environment requirements. The light source casing 4 is further mounted with a lens board 5 at its opening end. The lens board 5 is perforated with through holes at the positions corresponding to the LED lamps 7 and a ring groove with a width of 1 mm and a depth of 1 mm is arranged along the inner circumstance of each of the through holes to accommodate a high transmittance lens 8. Each high transmittance lens 8 is made of synthetic organic glass material to enhance its light transmittance.

Arranged at the rear end of the power casing 2 are two electrode rods 1, which are connected to the power converting module for receiving an alternating current (AC) input under 220V rated voltage at a power line frequency. The AC input from the electrode rods is then converted, rectified, filtered and regulated by the power converting module to produce a constant DC current, which matches with the driving requirements of LED lamps 7. After power-on, LED lamp emits visible light that takes the shape of an approximately uniform circular spot at a distance of 20 cm away from the light-emitting surface of the LED lamp.

The light source casing 4 is made of aluminum alloy with high heat dissipation. At the external surface of the curving wall of the light source casing 4, there are also several grooves 6 with a depth of 2-5 mm and a length of 5 mm, which increase the heat dissipation capability of the casing 4 to prevent LED lamp from overheating so that the lamps can stably work for long LED life time.

What is claimed is:

1. A high-power LED lamp set comprising:

a power supply casing (2);

electrode rods (1), arranged at a rear end of the power supply casing (2), for connecting to an external high-voltage AC power source;

a power converting module, located within the power supply casing (2) and connected with the electrode rods (1), for converting the high-voltage AC from the electrode rods into a constant low-voltage DC driving current;

a light source casing (4), connected with the power supply casing; and a plurality of LED lamps (7), mounted on a bottom surface of the light source casing (4) and driven by the driving current provided by the power converting module, and wherein said light source casing (4) is provided with a lens board (5) at its is opening end, wherein the lens board (5) is perforated with through holes at positions corresponding to the LED lamps, and a high transmittance lens (8) is fitted in each of the through holes.

2. The high-power LED lamp set of claim 1, wherein the power converting module provides said driving current through transformation, rectification and regulation; the light source casing (4) is provided with blind-holes at its bottom, each blind-hole having a small through holes at its center; LED lamps (7) are mounted on the bottom surface of the light source casing (4) through the blind-holes and the small through-holes.

3. The high-power LED lamp set of claim 1, wherein the power supply casing (2) has a rectangle part and a spherical part that are integrally formed as one-piece.

4. The high-power LED lamp set of claim 1, wherein the light source casing (4) has a bowl-like shape with a flat bottom.

5. The high-power LED lamp set of claim 1, wherein the power supply casing (2) and the light source casing (4) are connected and fixed together via bolts (3).

6. The high-power LED lamp set of claim 1, wherein grooves (6) for heat dissipation are arranged on an external surface of a curving wall of the light source casing (4).

7. The high-power LED lamp set of claim 1, wherein a ring groove is to arranged along the inner circumference of each of said through holes on the lens board (5) and the high transmittance lens (8) is fitted within the ring groove.

* * * * *